US006257924B1

(12) United States Patent
Lund et al.

(10) Patent No.: US 6,257,924 B1
(45) Date of Patent: Jul. 10, 2001

(54) STACKED ELECTRICAL CONNECTOR ASSEMBLY PROTECTOR

(75) Inventors: David G. Lund, Byron; Christopher Lee Tuma, Mantorville, both of MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/642,821

(22) Filed: Aug. 22, 2000

(51) Int. Cl.[7] ..... H01R 13/60
(52) U.S. Cl. ..... 439/541.5; 439/607
(58) Field of Search ..... 439/561.5, 79, 439/607

(56) References Cited

U.S. PATENT DOCUMENTS 5,199,886 * 4/1993 Patterson ..... 439/79
5,252,080 * 10/1993 Pesson ..... 439/79
5,564,948 * 10/1996 Harting et al. ..... 439/607
5,637,015 * 6/1997 Tan et al. ..... 439/607
5,672,064 * 9/1997 Provencher et al. ..... 439/79
5,743,765 * 4/1998 Andrews et al. ..... 439/608
6,095,861 * 8/2000 Lin et al. ..... 439/607
6,099,351 * 8/2000 Wu ..... 439/607

* cited by examiner

*Primary Examiner*—Tulsidas Patel
(74) *Attorney, Agent, or Firm*—Robert H Berdo, Jr

(57) ABSTRACT

A stacked electrical connector assembly and cover arrangement includes a stacked electrical connector assembly that includes a lower electrical connector, and an upper electrical connector disposed over the lower electrical connector in a stacked relationship. Each of the lower electrical connector and the upper electrical connector have at least one lead, with the lead of the upper electrical connector being longer than the lead of the lower electrical connector. A cover is disposed over the leads to protect at least the lead of the upper electrical connector from damage. The cover includes a back wall, and an edge wall that projects outward from the back wall. The back wall and the edge wall collectively define a recess that accommodates at least the lead of the upper electrical connector therein. The edge wall extends only partially around a periphery of the back wall to form an edge opening, so as to allow a portion of the stacked electrical connector assembly to extend out of the recess via the edge opening.

29 Claims, 6 Drawing Sheets

STACKED ELECTRICAL CONNECTOR ASSEMBLY PROTECTOR

BACKGROUND OF THE INVENTION

1. Field of the Invention

The invention relates to a stacked electrical connector assembly protector, and in particular, to a protector that will prevent damage to the leads of a stacked electrical connector assembly.

2. Background Information

Computer systems, for example, typically include a number of circuit boards which are electrically coupled with other circuit boards, input/output devices, or other electrical components. To facilitate this electrical coupling, and to allow the coupled component(s) to be easily removed from a respective circuit board, the circuit board may be provided with electrical connectors that serve as plugs to which the electrical component can be attached.

The conventional electrical connector, such as a so-called right angle connector, is provided with a plurality of leads, each of which is connected, for example, by soldering, to associated wirings of the circuit board. During assembly, the leads are typically inserted through respective holes of a set of holes in the circuit board and then soldered to the wirings.

The right angle connector is so named because the leads extend out of plug (either male or female) of the connector, which is arranged parallel to the surface of the circuit board, and are then directed downward, at a right angle, toward the surface of the circuit board, for connecting thereto. A corresponding electrical component can then be mated to the plug of the connector, using a cable, for example, in a known manner.

A current goal in the design of computers and computer peripherals, as well as other types of instruments, is reduction of size. Consequently, components such as electrical connectors have undergone dramatic changes in size. For example, the aforementioned right angle connectors have been miniaturized in size to reduce the amount of space needed to accommodate it. However, the mounting of even a miniaturized electrical connector requires a significant portion of the space on a given sized printed circuit board because the leads of the electrical connector are typically arranged in staggered rows of standard spacing, and because the electrical connector typically includes ears for receipt of mounting screws or other fastening means. The rows of the leads are typically spaced sufficiently apart to ensure against shorting among the leads during soldering.

Often a single printed circuit board will require a number of different electrical connectors. A board may, for example, be required to communicate with more than one outside instrument. Mounting of each succeeding electrical connector to a board further limits the possible size reduction of the circuit board, as well as limiting the design freedom in the routing of various signal paths via the wirings on the circuit board. Of course, it may possible to use a single electrical connector which is larger but which has a sufficient number of contact elements to couple all of the signal paths to and from a board. However, such a practice would require a specifically constructed cable which could branch off the signals to various circuit boards or instruments, as needed.

Thus, to economically use the limited space on a printed circuit board, so-called stacked electrical connector assemblies are now popularly used in the computer field. A typical stacked electrical connector assembly includes upper and lower electrical connectors connected together in superposed relationship, so as to provide two or more interface ports to a circuit board without consuming on the circuit board twice the area required for a single electrical connector. That is, the stacked electrical connector assembly uses substantially the same circuit board space as would a single electrical connector, but without the disadvantage of requiring a specially constructed cable or other special equipment for branching off various signals to multiple boards or instruments communicating through the electrical component.

Typically, both the lower electrical connector and the upper electrical connector of the stacked electrical connector assembly are right angle connectors, and are connected together using a variety of means. For example, one known stacked electrical connector assembly includes two 9 pin D-shell board mounted connectors, with the lower electrical connector being mounted directly on the surface of the printed circuit board, and the upper electrical connector being disposed on brackets, and over the lower electrical connector. Further, as will be appreciated, the leads of the upper electrical connector must extend a greater distance before reaching the surface of the circuit board than the leads of the lower electrical connector. Thus, the leads of the upper electrical connector are typically substantially longer than the leads of the lower electrical connector.

Moreover, it is conventional to leave the leads of the upper electrical connector substantially exposed. One reason for this is that, to facilitate the manufacturing process and reduce expenses, the upper electrical connector of a stacked electrical connector assembly is typically just a standard right angle connector with longer leads. Since the leads of the conventional single electrical connector are so short as to not need any type of cover or protector, it logically followed that the upper electrical connector likewise would not be provided with any type of lead protection device.

Further, by leaving the leads exposed, it is easier to align the ends of the leads with their respective holes formed in the circuit board. If the leads were covered during the manufacturing stage, and one or more of the leads was offset relative to its respective hole, it would be difficult, at best, to properly attach the stacked electrical connector assembly to the printed circuit board.

However, the exposed leads of the upper electrical connector, because they extend such a great distance, are susceptible to damage due to inadvertent contact with a tool, hand, or electrical component, for example, during a manufacturing stage of the computer, or by an end user. As is well known, a long lead is easier to deform than a short lead. Thus, inadvertent contact with the exposed long lead may cause the lead to shear and break, or come into contact with an adjacent lead, causing a short. Therefore, there is a need for a stacked electrical connector assembly protector that will protect the leads of an electrical connector from damage.

Furthermore, since the conventional stacked electrical connector assembly rises well above the surface of the circuit board, often a user may find it convenient to pick up the circuit board simply by grasping the stacked electrical connector assembly. Unless this is done in a careful manner, the user is likely to squeeze the exposed leads, causing them to bend, thus damaging the stacked electrical connector assembly. Thus, there is a need for an arrangement that will allow the conventional stacked electrical connector assembly to be securely grasped, without damaging the leads.

Moreover, since the manufactured conventional stacked electrical connector assembly is typically sold with exposed leads, there is a need for a protector that can be retrofitted for utilization with a conventional stacked electrical connector assembly.

Further, there is a need for a protector that can be easily and quickly attached to a conventional stacked electrical connector assembly, without modifying or altering the stacked electrical connector assembly in any manner.

Additionally, there is a need for a protector that can be easily and quickly removed from a conventional stacked electrical connector assembly, without damaging, modifying or altering the stacked electrical connector assembly in any manner.

SUMMARY OF THE INVENTION

It is, therefore, a principle object of this invention to provide a stacked electrical connector assembly protector.

It is another object of the invention to provide a stacked electrical connector assembly protector that solves the above mentioned problems.

These and other objects of the present invention are accomplished by the stacked electrical connector assembly protector disclosed herein.

According to one aspect of the invention, a shield is advantageously provided to prevent damage to the leads of an upper right angle connector of a stacked electrical connector assembly. The shield is placed over the rear of the stacked electrical connector assembly, and may advantageously be formed from an insulating material, such as a plastic. By forming the shield of a plastic material, the resulting cover can advantageously be provided with sufficient rigidity and strength. Moreover, a plastic cover can be manufactured quickly and inexpensively, for example, by molding. Further, by using an insulating material, should the cover inadvertently come into contact with the leads of the right angle connectors, the cover will not cause a short.

In a further exemplary aspect of the present invention, the shield is formed from a conductive or semi-conductive material, so as to allow the shield to serve as an EMC (electromagnetic compatible) shield. An insulating layer may then be formed on an inner surface of the shield, to ensure that the shield does not inadvertently cause a short with the leads.

The shield may be provided with a back wall, and an edge wall that projects outward from the back wall, and which extends at least partially around a periphery of the back wall. The back wall and the edge wall thus collectively define a recess , in which a rear portion of the stacked electrical connector assembly is advantageously accommodated. This arrangement advantageously covers most or all exposed portions of the leads, so that the leads are protected from damage.

In an exemplary embodiment, the edge wall only extends around a portion of the periphery of the back wall, so that an edge opening is formed that communicates with the recess. The edge opening advantageously allows the bottom portion of the stacked electrical connector assembly to project from the shield, and allows the shield to be easily slid down over the stacked electrical connector assembly.

In a further exemplary embodiment of the invention, the shield includes a means for attaching the shield to the stacked electrical connector assembly. For example, the shield may be provided with flanges disposed on lower edges of the edge wall on opposite sides of the edge opening. The flanges project toward each other, and engage, for example, with corresponding grooves formed in the stacked electrical connector assembly. To facilitate the positioning of the shield onto the stacked electrical connector assembly, the flanges may be beveled, so that the flanges will slide easily into engagement with the corresponding grooves , but will not inadvertently disengage with the grooves. Nevertheless, by flexing the lower edges of the edge wall outward, the flanges can be disengaged from the corresponding grooves, allowing the shield to be easily removed.

In an exemplary aspect of the invention, the shield is tailored to conform to the shape of the rear portion of the stacked electrical connector assembly. For example, the back wall may be provided with an inverted T configuration, defined by a large rectangular-shaped portion, and a smaller rectangular-shaped portion. This configuration would provide the edge wall with a stepped configuration, so that horizontal portions of the edge wall correspond with horizontal surfaces of the upper right angle connector, and vertical portions of the edge wall correspond with vertical surfaces of the stacked electrical connector assembly. Thus, when the shield is in place on the stacked electrical connector assembly, the tailored configuration of the shield advantageously prevents the shield from unnecessary shifting, which may otherwise cause the shield to become inadvertently disengaged.

Further, the tailored configuration of the shield allows the shield to be gripped without damaging the leads. Thus, the stacked electrical connector assembly can be safely utilized to move the associated printed circuit board.

DETAILED DESCRIPTION OF THE PREFERRED EMBODIMENTS

The invention will now be described in more detail by way of example with reference to the embodiments shown in the accompanying figures. It should be kept in mind that the following described embodiments are only presented by way of example and should not be construed as limiting the inventive concept to any particular physical configuration.

Further, if used and unless otherwise stated, the terms "upper", "lower", "front", "back", "over", "under", and similar such terms are not to be construed as limiting the invention to a particular orientation. Instead, these terms are used only on a relative basis.

Figure 2:
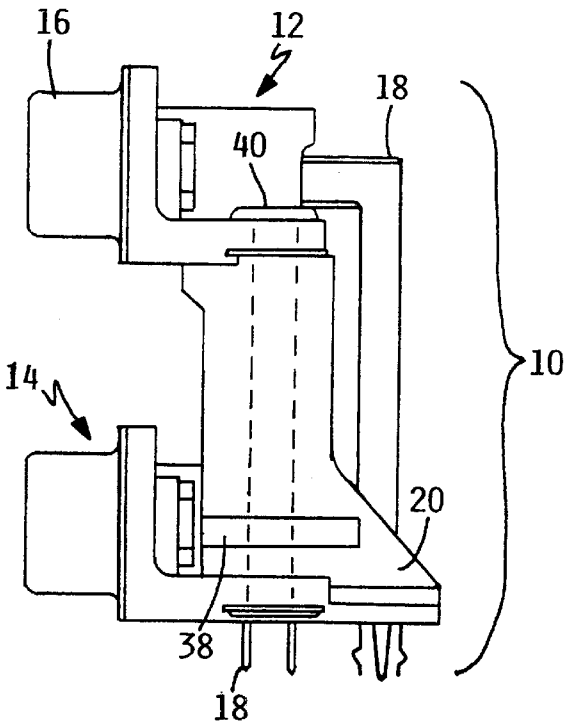
FIG. 2 (PRIOR ART)
FIG. 2 is a side elevational view of the conventional stacked electrical connector assembly.
Figure 1:
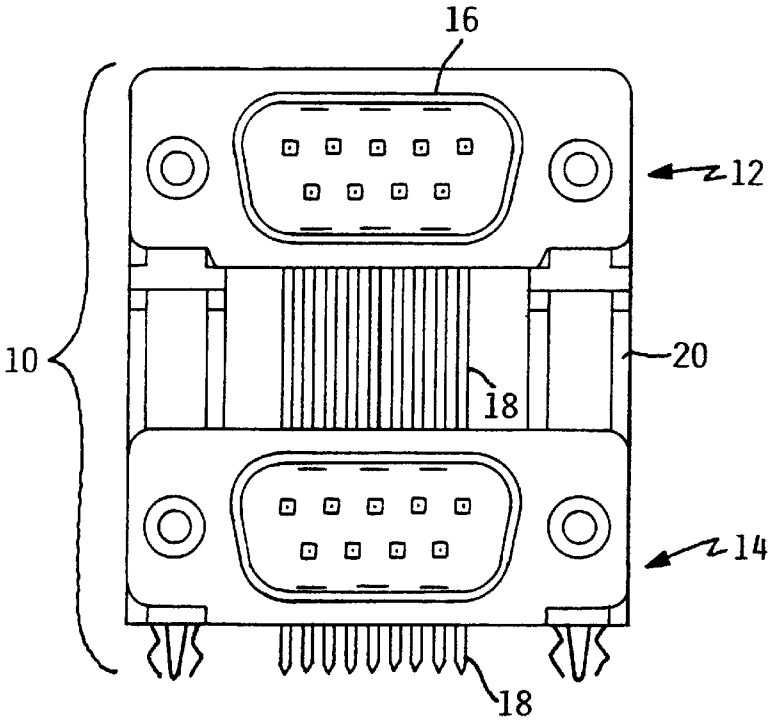
FIG. 1 (PRIOR ART)
FIG. 1 is a front elevational view of a conventional stacked electrical connector assembly.

FIGS. 1 and 2 illustrate an exemplary conventional stacked electrical connector assembly 10, with which the present invention may be utilized. For explanatory purposes, the stacked electrical connector assembly 10 is a double stacked electrical connector assembly, manufactured by AMP Incorporated, of Harrisburg Pennsylvania. The illustrated stacked electrical connector assembly 10 is formed by disposing an upper right angle connector 12 over a lower right angle connector 14. However, the present invention is not limited to this particular stacked electrical connector assembly. To the contrary, the present invention may be utilized with any type of stacked electrical connector assembly. Moreover, although the present invention has shown to be particularly advantageous when used in conjunction with a stacked electrical connector assembly, the invention may be utilized with other connectors or electrical components, or in other applications, without departing from the spirit and scope of the invention.

Briefly, each of the right angle connectors 12, 14 of the illustrated stacked electrical connector assembly 10 includes a plug port 16 on a front side thereof, to which a cable (not shown), for example, can be attached, so as to couple the respective right angle connector to an input/output device (not shown), such as a mouse or a keyboard. Further, each of the right angle connectors 12, 14 has a plurality of leads 18 extending horizontally out of a rear of the respective port 16 for a short distance, for example several millimeters, before turning downwards at a right angle. In the illustrated exemplary embodiment, each right angle connector 12, 14 is a nine-pin D-shell board mounted connector, having nine leads arranged in two staggered rows.

Figure 3:
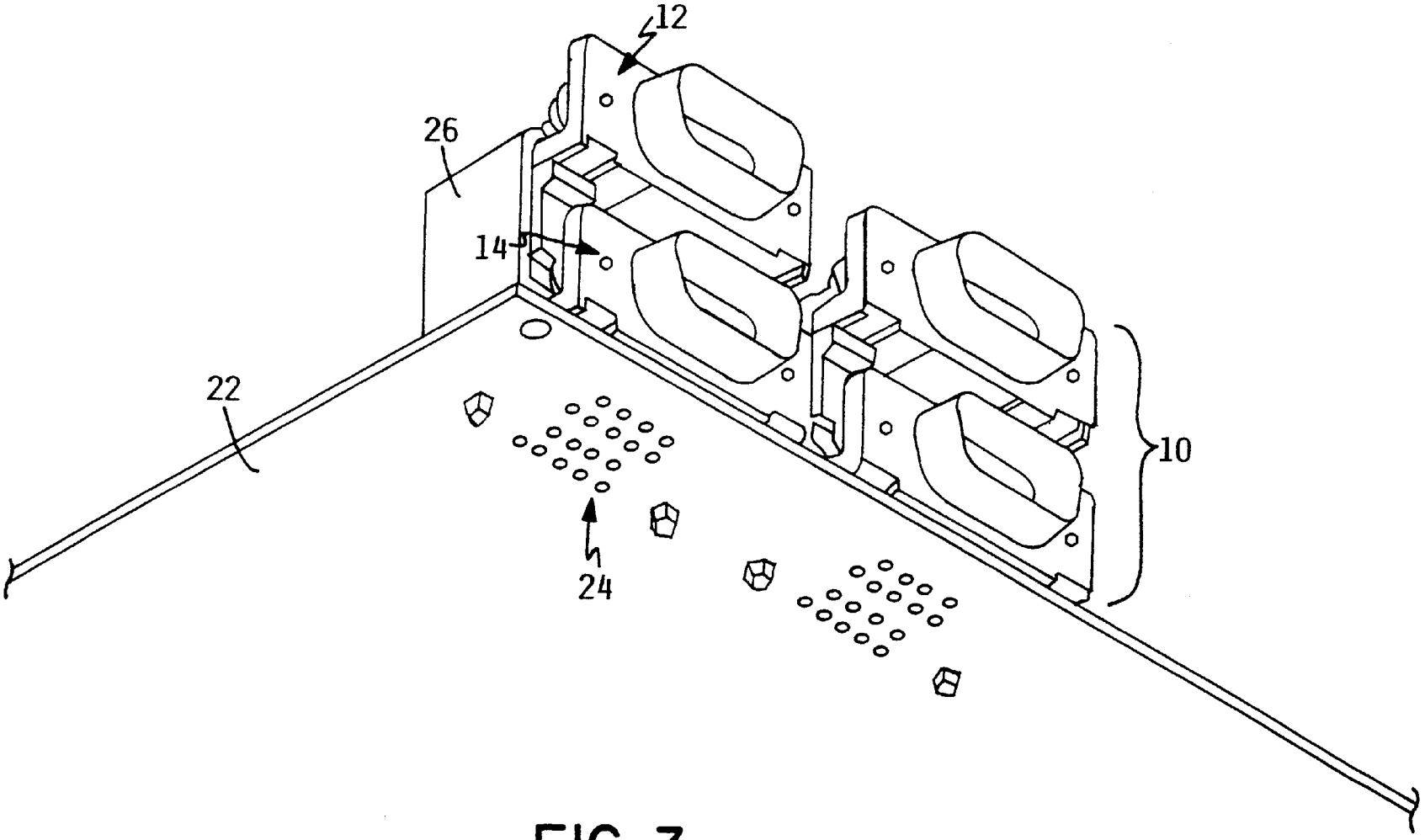
FIG. 3 is a front perspective view of a shield according to the present invention, attached to the conventional stacked electrical connector assembly, which is shown attached to a printed circuit board.

Further, the illustrated stacked electrical connector assembly 10 includes opposing columns 20, which serve as a bracket for supporting the upper right angle connector 12 over the lower right angle connector 14, so that the two right angle connectors occupy essentially the same footprint as would only one similarly configured right angle connector. Additionally, and referring also to FIG. 3, each lead 18, after turning downwards, extends into contact with a circuit board 22, for coupling the lead to wirings (not shown) therein. For example, in the illustrated embodiment, the circuit board 22 has eighteen through holes 24 formed therein for each stacked electrical connector assembly 10, i.e., one hole 24 for each respective lead. The ends of the leads are brought through the respective holes, and soldered in place.

Figure 4:
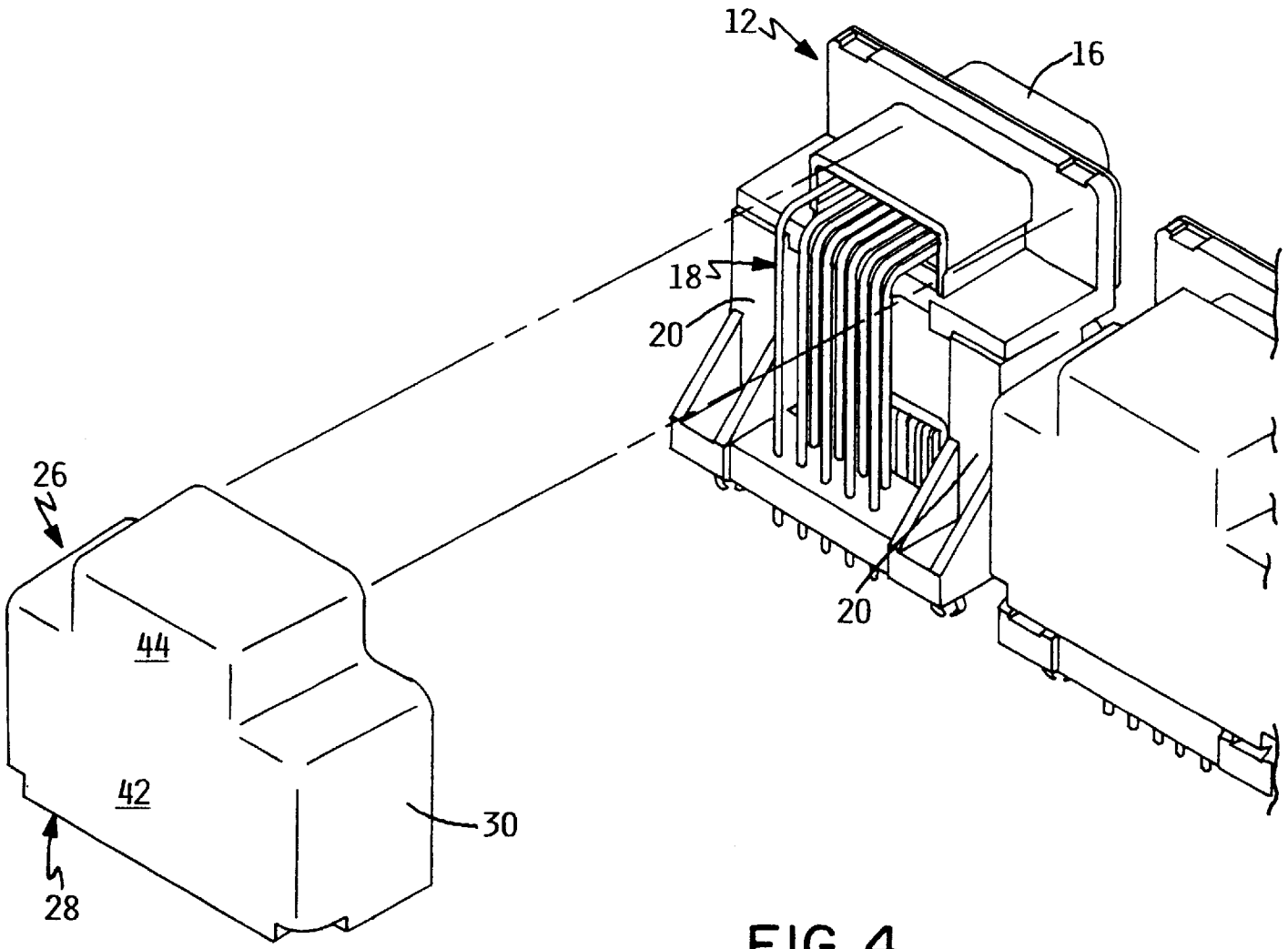
FIG. 4 is a rear perspective view of the shield according to the present invention, prior to being attached to the conventional stacked electrical connector assembly.

Referring also to FIG. 4, since the upper right angle connector 12 is disposed further away from the surface of the circuit board 22 (shown only in FIG. 3) than the lower right angle connector 14, the leads 18 of the upper right angle connector are tailored to be substantially longer than the leads of the lower right angle connector. For example, the leads 18 of the upper right angle connector 12, after turning downwards, may extend for two or three centimeters before reaching the surface of the circuit board, whereas the leads 18 of the lower right angle connector 14 typically extend for less than a centimeter after turning downwards. Thus, the leads 18 of the upper right angle connector 12 provide a large target that may be inadvertently contacted and subsequently damaged.

Figure 5:
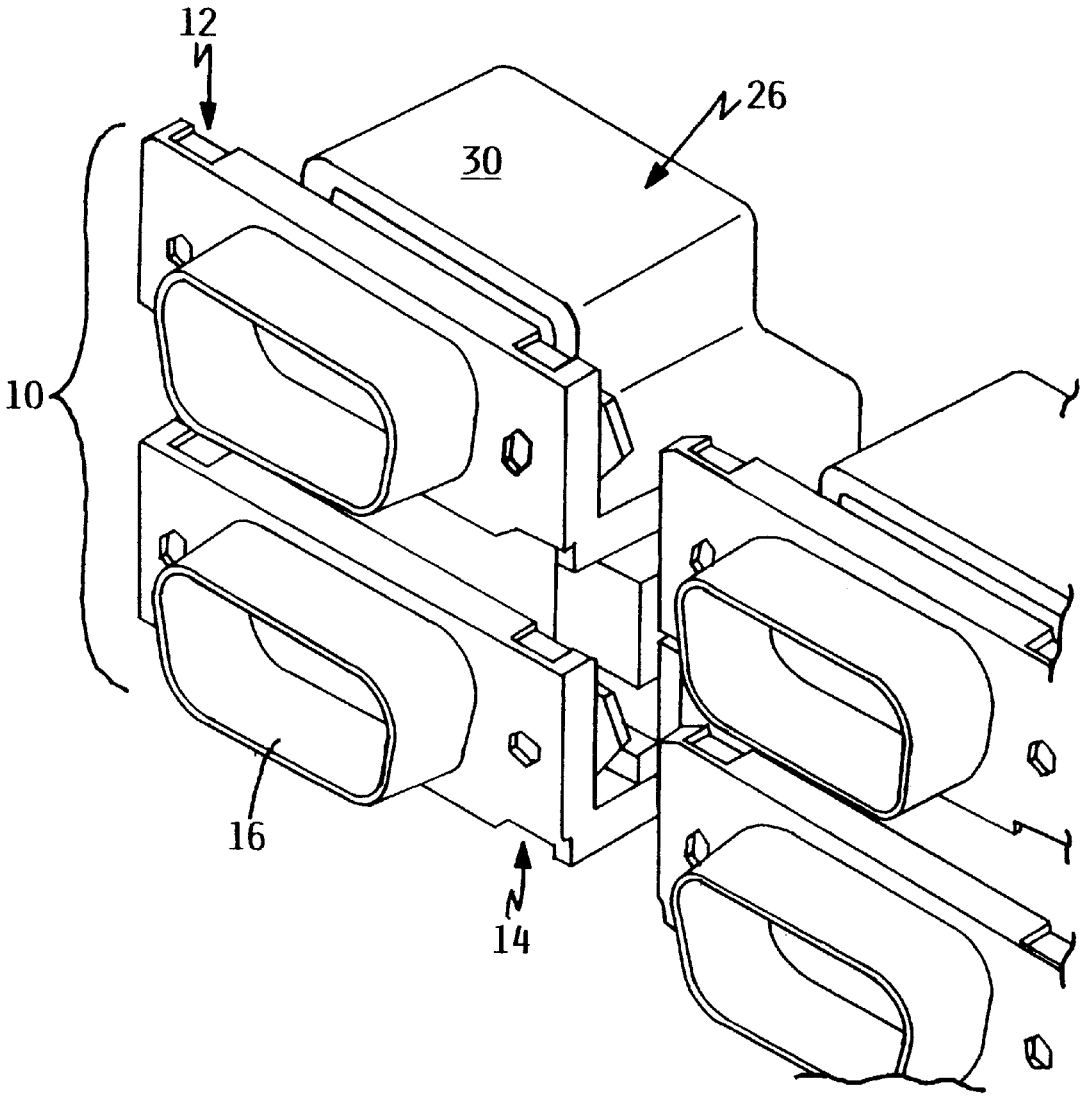
FIG. 5 is a front perspective view of the shield according to the present invention, attached to the conventional stacked electrical connector assembly.
Figure 6:
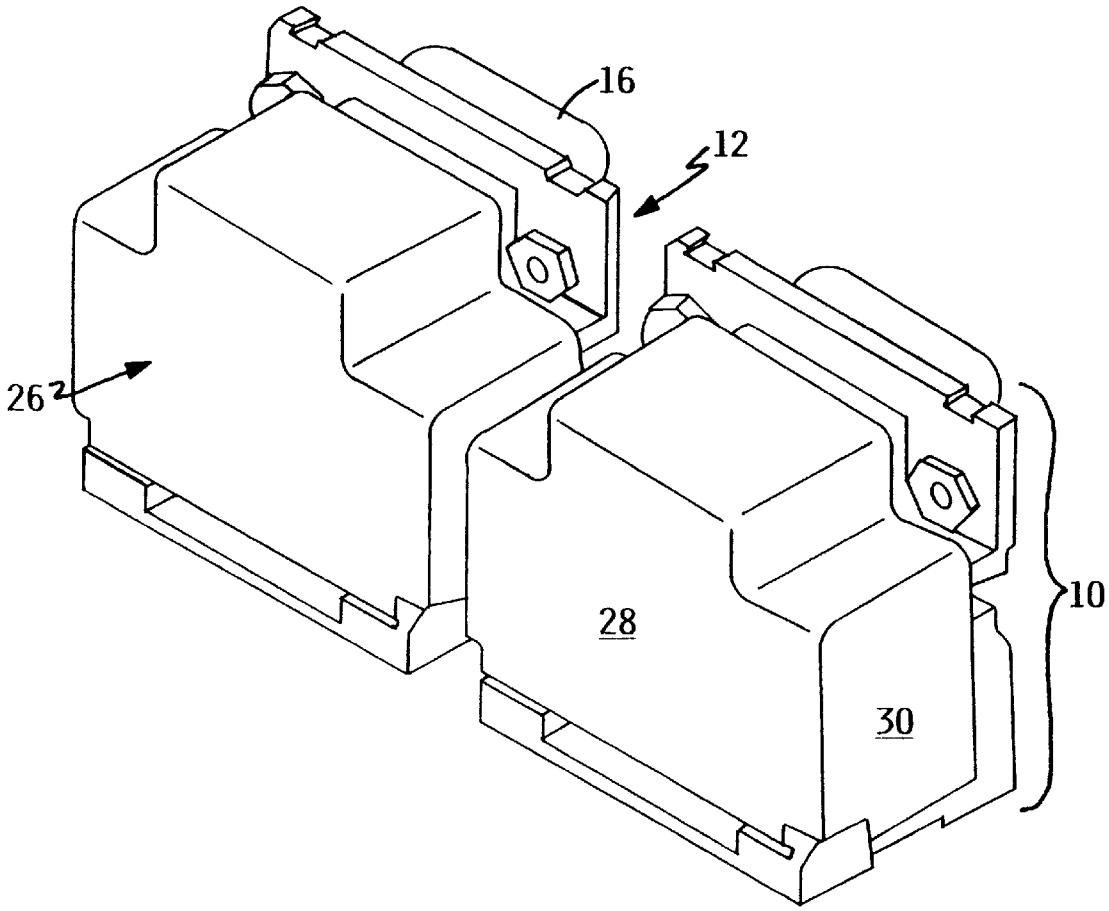
FIG. 6 is a rear perspective view of the shield according to the present invention, attached to the conventional stacked electrical connector assembly.
Figure 7:
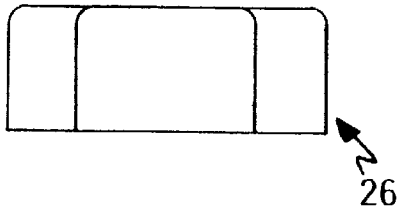
FIG. 7 is a top down view of the shield according to the present invention.
Figure 8:
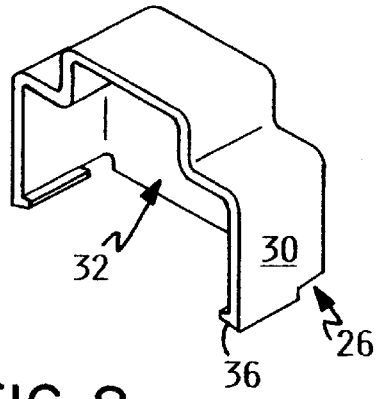
FIG. 8 is a perspective view of the shield according to the present invention.
Figure 9:
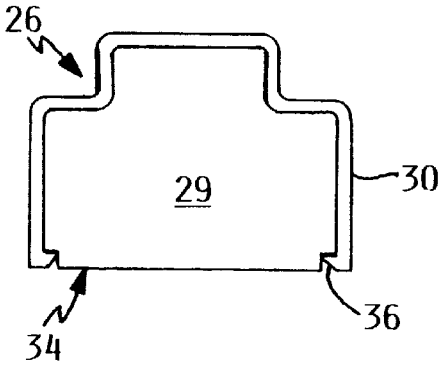
FIG. 9 is an inside elevational view of the shield according to the present invention.
Figure 10:
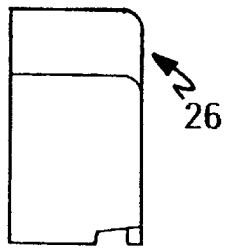
FIG. 10 is a side view of the shield according to the present invention.

Referring also to FIGS. 5 and 6, to prevent damage to the leads 18, and in particular to prevent damage of the leads of the upper right angle connector 12, the present invention includes a shield 26 that is placed over the rear of the stacked electrical connector assembly 10. In the exemplary embodiment, the shield 26 is a cover formed from an insulating material, such as a plastic. By forming the shield of a plastic material, the resulting cover can advantageously be provided with sufficient rigidity and strength. Moreover, a plastic cover can be manufactured quickly and inexpensively, for example, by molding. Further, by using an insulating material, should the cover inadvertently come into contact with the leads of the right angle connectors, the cover will not cause a short. However, it is also contemplated that the shield could be formed from a conductive or semi-conductive material, so as to allow the shield to serve as an EMC (electromagnetic compatible) shield. An EMC shield is a shield which allows operation in an electromagnetic environment at an optimal level of efficiency, and which allows static charges to be drained to a frame ground. With such an arrangement, it may be further advantageous to provide an insulating layer (not shown) on an inner surface of the shield, to ensure that the shield does not inadvertently cause a short with the leads.

Referring additionally to FIGS. 7–10, the shield 26 includes a back wall 28, and an edge wall 30 that projects outward from the back wall, and which extends at least partially around a periphery of the back wall. The back wall 28 and the edge wall 30 thus collectively define a recess 32, in which a rear portion of the stacked electrical connector assembly is accommodated. In the exemplary embodiment, the shield 26 covers a major portion (over 50 percent, and preferably over 75%) of the leads 18 of upper right hand connector 12, with only a lower portion of the leads being exposed. For example, the lower five millimeters or so of the leads can remain exposed, without diminishing the protective capability of the shield 26. Of course, if desired, the shield 26 can be adapted to cover essentially all exposed portions of the leads 18, so that no portion of the leads is exposed.

In the exemplary embodiment, the edge wall 30 only extends around a portion of the periphery of the back wall 28, so that an edge opening 34 is formed that communicates with the recess 32. The edge opening 34 allows the bottom portion of the stacked electrical connector assembly 10 to project from the shield 26, and allows the shield to be slid down over the stacked electrical connector assembly.

Preferably, the shield 26 includes a means for attaching the shield to the stacked electrical connector assembly 10. In the illustrated embodiment, the shield 26 includes flanges 36 disposed on lower edges of the edge wall 30 on opposite sides of the edge opening 34. The flanges 36 project toward each other, and engage with corresponding grooves 38 (best shown in FIG. 2) formed in sides of the columns 20 of the stacked electrical connector assembly 10. To facilitate the positioning of the shield 26 onto the stacked electrical connector assembly 10, the flanges 36 may be beveled, so that the flanges will slide easily into engagement with the corresponding grooves 38, but will not inadvertently disengage with the grooves. Nevertheless, by flexing the lower edges of the edge wall 30 outward, the flanges 36 can be disengaged from the corresponding grooves 38, allowing the shield 26 to be removed.

Moreover, it is also contemplated that the flanges 36 can be positioned to engage with other features of the stacked electrical connector assembly 10, should the stacked electrical connector assembly not be provided with columns, or grooves in the columns. Alternatively, or in addition to the flanges 36, other means for attaching the shield 26 to the stacked electrical connector assembly 10 may be provided. For example, the illustrated stacked electrical connector assembly 10 includes two eyelets 40 (only one being shown in FIG. 2) that extend through the upper right angle connector 12, and vertically downward into the top portions of the corresponding columns 20, so as to hold the upper right angle connector to the columns. The shield 26 could thus be provided with corresponding pins (not shown) on an inner surface of the edge wall 30, which would be insertable into the associated eyelet holes, to hold the shield in place. When used with the previously described flanges 36, this arrangement would hold the shield to the stacked electrical connector assembly 10 in essentially a permanent relationship.

In the exemplary illustrated embodiment, and as best shown in FIG. 4, the shield 26 is tailored to conform to the shape of the rear portion of the stacked electrical connector assembly 10. In this embodiment, the back wall 28 has essentially an inverted T configuration, defined by a large rectangular-shaped portion 42, and a smaller rectangular-shaped portion 44. The smaller rectangular-shaped portion 44 is centrally disposed on an upper edge of the large rectangular-shaped portion 42, and is tailored to have a height and width that essentially only covers a rear of the upper right angle connector 12, in a portion where the leads 18 project therefrom. This configuration provides the edge wall 30 with a stepped configuration, so that horizontal portions of the edge wall correspond with horizontal surfaces of the upper right angle connector 12, and vertical portions of the edge wall correspond with vertical surfaces of the upper right angle connector and the columns 20. Thus, when the shield 26 is in place on the stacked electrical connector assembly 10, the tailored configuration of the shield advantageously prevents the shield from unnecessary shifting, which may otherwise cause the shield to become inadvertently disengaged.

Further, the tailored configuration of the shield 26 allows the shield to be gripped without damaging the leads 18. To facilitate the gripping of the shield 26, it is contemplated that the back wall 28 and/or the edge wall 30 may be provided with a textured surface (not shown). Thus, the stacked electrical connector assembly 10 can be safely utilized to move the associated printed circuit board.

It should be understood, however, that the invention is not necessarily limited to the specific arrangement and components shown and described above, but may be susceptible to numerous variations within the scope of the invention.

It will be apparent to one skilled in the art that the manner of making and using the claimed invention has been adequately disclosed in the above-written description of the preferred embodiments taken together with the drawings.

It will be understood that the above description of the preferred embodiments of the present invention are susceptible to various modifications, changes, and adaptations, and the same are intended to be comprehended within the meaning and range of equivalents of the appended claims.

What is claimed is:

1. In combination, an electrical component having at least two electrical leads, said electrical component comprising a stacked electrical connector assembly including a lower electrical connector having one of the at least two leads, and an upper electrical connector disposed over the lower electrical connector in a stacked relationship, the upper electrical connector including another one of the at least two leads, the lead of the upper electrical connector being longer than the lead of the lower electrical connector; and means for shielding the leads, and comprising a cover that is disposed over the leads, said cover having a recess that accommodates at least the lead of the upper electrical connector therein, said cover further including a back wall, and an edge wall that projects outward from the back wall, the back wall and the edge wall collectively defining the recess, the edge wall extending only partially around a periphery of the back wall to form an edge opening, so as to allow a portion of the stacked electrical connector assembly to extend out of the recess via the edge opening, said edge wall including means for removably attaching said cover to said stacked electrical connector assembly, wherein said means for removably attaching includes a flange that projects into the recess, and which engages with the stacked electrical connector assembly.

2. The combination recited in claim 1, wherein said means for shielding protects the lead from damage.

3. The combination recited in claim 1, wherein at least one of said upper electrical connector and said lower electrical connector comprises a right angle electrical connector.

4. The combination recited in claim 1, wherein each of said upper electrical connector and said lower electrical connector comprises a right angle electrical connector.

5. The combination recited in claim 1, wherein said cover protects at least the lead of the upper electrical connector from damage.

6. The combination recited in claim 5, wherein said cover is formed from an insulating material.

7. The combination recited in claim 6, wherein the insulating material is a plastic material.

8. The combination recited in claim 1, wherein said flange is beveled to facilitate an engagement between said cover and said stacked electrical connector assembly, and to prevent an inadvertent removal of said cover from said stacked electrical connector assembly.

9. The combination recited in claim 1, wherein said cover is tailored to conform to a shape of an underlying portion of said stacked electrical connector assembly.

10. The combination recited in claim 9, wherein said edge wall has a stepped configuration, and wherein said back wall has an inverted T shape.

11. The combination recited in claim 1, wherein said means for shielding is an EMC shield.

12. The combination recited in claim 1, wherein said flange comprises two flanges arranged on opposite sides of the recess and that project toward each other.

13. The combination recited in claim 12, wherein said stacked electrical connector assembly has at least two grooves formed therein, each flange being directly engagable with a respective groove.

14. The combination recited in claim 1, wherein each of said electrical connectors comprises a multiple-pin D-shell board mounted connector.

15. The combination recited in claim 1, wherein said stacked electrical connector assembly further comprises first and second opposing columns, said upper electrical connector being supported by said opposing columns.

16. The combination recited in claim 15, wherein said flange comprises two flanges arranged on opposite sides of the recess and that project toward each other.

17. The combination recited in claim 16, wherein each of said first and second columns has at least one groove formed therein, each flange being directly engagable with a respective groove.

18. The combination recited in claim 1, wherein said flange comprises two flanges arranged on opposite sides of the recess and that project toward each other, and wherein the edge wall extends continuously around the periphery of the back wall from one flange to the other flange.

19. A cover for shielding an electrical lead of a stacked electrical connector assembly, comprising:

a back wall; and an edge wall that projects outward from the back wall, the back wall and the edge wall collectively defining a recess that accommodates the lead of the stacked electrical connector assembly therein, said edge wall including means for removably attaching said cover to the stacked electrical connector assembly, wherein said means for removably attaching includes a flange that projects into the recess, and which is engagable with the stacked electrical connector assembly.

20. The cover recited in claim 19, wherein the edge wall extends only partially around a periphery of the back wall to form an edge opening, so as to allow a portion of the stacked electrical connector assembly to extend out of the recess via the edge opening.

21. The cover recited in claim 19, wherein said cover protects the lead from damage.

22. The cover recited in claim 19, wherein said cover is formed from an insulating material.

23. The cover recited in claim 22, wherein the insulating material is a plastic material.

24. The cover recited in claim 19, wherein said flange is beveled to facilitate an engagement between said cover and said stacked electrical connector assembly, and to prevent an inadvertent removal of said cover from said stacked electrical connector assembly.

25. The cover recited in claim 19, wherein said edge wall has a stepped configuration, and wherein said back wall has an inverted T shape.

26. The cover recited in claim 19, wherein said cover is an EMC shield.

27. The cover recited in claim 19, wherein said flange comprises two flanges arranged on opposite sides of the recess and that project toward each other.

28. The cover recited in claim 27, wherein the edge wall extends continuously around a periphery of the back wall from one flange to the other flange.

29. A printed circuit board assembly for a computer system, comprising:

a printed circuit board;

a stacked electrical connector assembly disposed on a surface of the printed circuit board, and comprising a lower electrical connector, and an upper electrical connector disposed over the lower electrical connector in a stacked relationship, each of said lower electrical connector and said upper electrical connector having at least one lead electrically coupled to said printed circuit board, the lead of the upper electrical connector being longer than the lead of the lower electrical connector; and a cover that is disposed over the leads to protect at least the lead of the upper electrical connector from damage, said cover including a back wall, and an edge wall that projects outward from the back wall, the back wall and the edge wall collectively defining a recess that accommodates at least the lead of the upper electrical connector therein, the edge wall extending only partially around a periphery of the back wall to form an edge opening, so as to allow a portion of the stacked electrical connector assembly to extend out of the recess via the edge opening, said edge wall including a flange that projects into the recess, and which is engagable with the stacked electrical connector assembly for removably attaching said cover to the stacked electrical connector assembly, said flange being beveled to facilitate an engagement between said cover and said stacked electrical connector assembly, and to prevent an inadvertent removal of said cover from said stacked electrical connector assembly.

* * * * *